US007213823B1

(12) United States Patent
Vujtech

(10) Patent No.: US 7,213,823 B1
(45) Date of Patent: May 8, 2007

(54) TWO-WHEELED RIDING-BOARD APPARATUS

(76) Inventor: James A. Vujtech, 6508 Fitch Rd., Olmsted Township, OH (US) 44138

( * ) Notice: Subject to any disclaimer, the term of this patent is extended or adjusted under 35 U.S.C. 154(b) by 196 days.

(21) Appl. No.: 11/034,470

(22) Filed: Jan. 13, 2005

(51) Int. Cl.
*B62M 1/00* (2006.01)

(52) U.S. Cl. ..... 280/87.021; 280/87.042

(58) Field of Classification Search ..... 280/87.01, 280/87.021, 87.03, 87.041, 87.042, 842, 280/843, 11.204, 11.211, 11.214, 47.2
See application file for complete search history.

(56) References Cited

U.S. PATENT DOCUMENTS

| | | | | | |
|---|---|---|---|---|---|
| 1,123,686 | A * | 1/1915 | Cole et al. | ..... | 280/87.042 |
| 1,147,566 | A * | 7/1915 | Taylor | ..... | 280/87.041 |
| 3,767,220 | A * | 10/1973 | Peterson | ..... | 280/842 |
| 3,856,321 | A * | 12/1974 | Solymosi | ..... | 280/87.041 |
| 4,021,052 | A * | 5/1977 | Knowles | ..... | 280/842 |
| 4,050,705 | A * | 9/1977 | Kreis | ..... | 280/842 |
| 4,055,234 | A * | 10/1977 | Burton | ..... | 188/2 R |
| 4,076,266 | A * | 2/1978 | Krausz | ..... | 280/87.042 |
| 4,323,258 | A * | 4/1982 | Culpeper | ..... | 280/7.12 |
| 4,744,576 | A * | 5/1988 | Scollan, Jr. | ..... | 280/87.042 |
| 4,886,298 | A | 12/1989 | Shols | ..... | 280/842 |
| 4,887,824 | A * | 12/1989 | Zatlin | ..... | 280/87.042 |
| 4,892,332 | A | 1/1990 | Jennings | ..... | 280/842 |
| 4,943,072 | A * | 7/1990 | Henig | ..... | 280/11.215 |
| 4,991,861 | A * | 2/1991 | Carn et al. | ..... | 280/87.042 |
| 5,096,225 | A | 3/1992 | Osawa | ..... | 280/842 |
| 5,160,155 | A * | 11/1992 | Barachet | ..... | 280/87.042 |
| 5,169,165 | A * | 12/1992 | Oates | ..... | 280/87.03 |
| 5,312,258 | A | 5/1994 | Giorgio | ..... | 434/253 |
| 5,354,081 | A * | 10/1994 | Huffman et al. | ..... | 280/87.01 |
| 5,399,140 | A | 3/1995 | Klippel | ..... | 482/146 |
| 5,533,950 | A | 7/1996 | Lochbaum | ..... | 482/51 |
| 5,833,252 | A * | 11/1998 | Strand | ..... | 280/87.042 |
| 5,855,385 | A * | 1/1999 | Hambsch | ..... | 280/87.042 |
| 6,296,082 | B1 * | 10/2001 | Tsai | ..... | 188/19 |
| 6,338,494 | B1 | 1/2002 | Killiam | ..... | 280/87.042 |
| 6,398,237 | B1 * | 6/2002 | Attey | ..... | 280/87.042 |
| 6,419,249 | B1 | 7/2002 | Chen | ..... | 280/87.042 |
| 6,666,797 | B1 | 12/2003 | Martin | ..... | 482/51 |

(Continued)

FOREIGN PATENT DOCUMENTS

EP 620031 A1 * 10/1994

(Continued)

*Primary Examiner*—Christopher Bottorff
(74) *Attorney, Agent, or Firm*—Joseph H. Taddeo

(57) ABSTRACT

This novel all-terrain, two-wheeled, riding-board provides a safe operating sport-ride to the user. Two large diameter wheels, one fore and one aft, are provided to improve the safety of this novel riding-board. Each wheel has a resilient elastomeric pneumatic tire mounted on each rim. A dual set of smaller stabilizer wheels are mounted outwardly at the rear of the deck to limit the travel and prevent tipping over. The outboard repositionable stabilizer wheels also serve to function as maneuvering devices, where the rider, by shifting his body weight over one of the stabilizing wheels, can decisively change the direction of his descent, either to the left or to the right. A dual foot operated braking system is provided where the brake on each wheel is individually operated. Alternatively, the riding board is equipped with a dual braking system—a cable driven hand-brake and an automatically operated hill-brake.

12 Claims, 7 Drawing Sheets

U.S. PATENT DOCUMENTS

| | | | | |
|---|---|---|---|---|
| 6,672,602 | B2 * | 1/2004 | Way et al. | 280/87.01 |
| 6,808,187 | B1 * | 10/2004 | Harris | 280/87.01 |
| 6,811,165 | B2 * | 11/2004 | Chang | 280/87.041 |
| 7,000,930 | B2 * | 2/2006 | Smith | 280/87.021 |
| 2002/0105158 | A1 * | 8/2002 | Stewart et al. | 280/87.041 |
| 2003/0164269 | A1 * | 9/2003 | Attey | 188/19 |

FOREIGN PATENT DOCUMENTS

| | | | |
|---|---|---|---|
| FR | 2607713 | A1 * | 6/1988 |

* cited by examiner

PRIOR ART

TWO-WHEELED RIDING-BOARD APPARATUS

REFERENCE TO PREVIOUSLY FILED APPLICATIONS

Applicant claims the benefit of U.S. patent application Ser. No. 10/855,746, filed by him on May 28, 2004.

FIELD OF INVENTION

The present invention relates primarily to a novel all-terrain, riding-board device, used for recreational and athletic purposes, and more particularly to a two-wheeled, riding-board apparatus that performs stably in all-terrains, and simulates on land, the motion and ride obtained on a skateboard, a snowboard or even a surfboard.

BACKGROUND OF THE INVENTION

There are three related recreational sporting events that appeal initially to a small group of surfers, backcountry enthusiasts, and skateboarders, for year-round participation and enjoyment. In the aquatic sporting events, a surfboard is used, whereas in summer land sporting events, skateboards are used, and in the winter season, the snowboards are primarily used.

The modern surfboards are large boards constructed of a plastic foam core that is shaped by machine or hand-shaped, and covered with a thin shell of fiberglass and resin. Surfboard dimensions vary widely and are governed by the needs of the enthusiast. High performance surfboards used by the top professionals vary typically from about 1.8 to 2 meters (6 ft.) in length and about 47 cm. (18.5 in.) in width; weighing about 2.7 kg (6 lbs.) and less than 6 cm. (2.5 in) thick. This style of board is also known as a "shortboard."

On the other end of the surfboard spectrum is the "longboard," where most longboards are 2.7 m. (9 ft.) long, 51 to 56 cm. (20 to 22 in.) wide, weighing less than 7 kg (15 lb and about the same thickness as the shortboard. The bottom of this board has from one to five fins near the tail, where the three-fin, thruster design is considered to be standard. These fins provide the board with directional stability and enhance performance by providing additional power and forward drive. Either style board can be used in recreational or in professional contexts, however, the shortboard performs better for speed and aerial maneuvers.

Snowboarding, on the other hand, is a sport often described as "surfing on snow." Snowboarders descend a slope by standing sideways on a lightweight board about 150 cm (about 5 ft) long, attached to their feet.

With snowboarding, the board lengths vary according to the size of the rider and the type of riding the rider does. Adult sized snowboards range from about 140 cm. to 180 cm. (about 4 ft. 7 in. to 5 ft. 11 in.). "Freestyle boards" are shortest, for easy maneuverability, whereas, the "freeride boards" are medium in length. "Carving boards" are still longer, so that can perform best at higher speeds. The longest are the "Alpine race boards" that may be as long as 190 cm. (6 ft 3 in.). These boards utilize a variety of bindings to hold the boots to the board, including metal fasteners, plastic straps, and step-in versions. Bindings having high backs behind the heels provide support and added leverage on turns.

Unlike skiers, who shift their weight from one ski to the other, snowboarders shift their weight from heels (heelside) to toes as well as from one end of the board to the other.

When snowboarders shift their weight toward the nose (front of the board), the board heads downhill. When snowboarders shift their weight toward the tail (back of the board), they head uphill or slow down. Riders achieve quick turns by pushing the back foot forward or pulling it backward to change direction. They stop the board's motion by pushing heels or toes down hard to dig the edge of the snowboard into the snow.

Most winter resorts now have special areas for snowboarding known as halfpipes—a long, deep trench dug in the snow and shaped like a pipe cut in half along its length, where riders "drop in" the pipe, using the walls of the trench to launch themselves into the air and perform a variety of jumps and spins. Tricks range from riding backwards, called riding fakie, to spectacular spins and flips performed in the halfpipe.

Skateboarding is an athletic activity that involves riding on a specially designed four-wheeled wooden board. The enthusiast most generally rides skateboards on the pavement or any other surface that gives a relatively smooth ride. Originally, the sport was known as "sidewalk surfing" but soon established its own identity.

The earliest skateboards first appeared in the 1940s and 1950s, where many of the early boards were toy scooters whose handlebars had been removed. Other homemade skateboards were steel-wheeled roller skates nailed onto a piece of wood. The first commercially produced skateboards appeared in the early 1960s, when Makaha Skateboards established a successful business.

By the 1970s, skateboard design had advanced, and the models produced were much safer than those of earlier years. This was because companies were making wheels, trucks, and other parts specially designed for skateboards. For many years skateboard construction varied among manufacturers, as plastic, fiberglass, metal, and wood were tested as deck materials, but by the late 1970s wood had won out as the optimum material. Decks constructed of seven-ply laminated wood tended to be lighter and stronger than those made of other materials.

Skateboarding became a competitive sport when curved plywood ramps were designed for use in skateboarding—these ramps were first used in 1975 in Melbourne Beach, Fla.

A skateboard is comprised of four wheels attached to two axles called trucks that are mounted to the bottom of a wooden board called a deck. These decks are typically 79 cm. (31 in.) in length and about 20 cm. (8 in.) in width. Generally, seven layers of Canadian maple veneer, pressed and glued together, comprise the deck. To improve the strength and prevent the deck from splitting along the grain, the skateboard manufacturers alternate the direction of the wood grain of each layer. These decks feature a curved rise at each end—the front end is called a kicknose, and the one in the rear is called a kicktail. To perform the tricks and stunts, the skateboarders use the leverage from the kicked ends. An abrasive grip tape is normally used on the top surface to provide traction and prevent the rider from slipping off.

The trucks are most commonly mounted 33 to 38 cm. (13 to 15 in.) apart. They consist of a base plate that mounts to the deck with screws and a hanger that houses the axle. The wheels attach to each end of the axle. Most trucks are made of lightweight aluminum and allow a slight movement between the base plate and hanger. This flexibility allows riders to turn the skateboard by shifting their weight.

Skateboard wheels are made of a durable material called urethane. Standard wheels are 50 to 65 mm. 0.9 to 2.5 in. in diameter and 65 mm. (2.5 in. wide. Each wheel houses two sealed or shielded precision bearings. Protective equipment worn by skateboarders typically includes kneepads, elbow pads, wrist guards, gloves, and a helmet. The wearing of protective equipment is extremely important, especially for beginning riders.

The following prior art discloses the various aspects in the design and use of riding board apparatuses.

U.S. Pat. No. 5,855,385, granted Jan. 5, 1999, to S. G. Hambsch, discloses a wheeled board apparatus having a platform with concave sidecuts, where the wheeled board apparatus has a platform with first and second concave portions. At least two primary wheels are located along a central longitudinal axis, with at least three outrigger wheels located generally along each concave sidecut.

U.S. Pat. No. 6,338,494, granted Jan. 15, 2002, to M. Fillian, discloses a two wheel articulated board device which the user can operate on smooth rough or smooth terrain. The device has a rear board member and a front board member, which are connected at a pivot point. Each board member can rotate relative to the other board member around this pivot point. The device is supported by two wheels. A rear wheel, which extends rear of the board and above the level of the board and a front wheel, which extends forward of the board and above the level of the board. The front wheel is connected to the board by a front fork which attaches to the underside of the board. The rear wheel is connected to the board by a rear fork which attaches to the underside of the board. There is a flexible member that connects at one end with the underside of the device rear of the pivot point and at the other end at the underside of the device forward of the pivot point. The user motions the board forward by placing one foot on the rear board member with that foot oriented about 45 degrees off the major axis of the device. Forward motion is achieved by the user pushing against the ground with his/her other foot. Once the user has gained enough speed and begins coasting, the user repositions his/her feet perpendicular to the long axis of the device. While coasting the user can affect a change of direction by changing the relative orientation of his/her feet which arc initially parallel without lifting them off the device. Moving the user's feet by bringing his/her toes closer together causes the rear board member to move relative to the front board member around the pivot point and thus affects a change of direction of the device. A flexible member running under the device along the major axis of the device and connected at one end to the rear board member and at the other end to the front board member applies a force to keep each board member aligned along their respective major axes.

U.S. Pat. No. 6,672,602, granted Jan. 6, 2004, to F. L. Way, II, et al., discloses a gravity driven steerable vehicle having wheels, or skis or a combination of wheels and skis for recreational use, most particularly on surfaces such as pavement, artificial hardpack turf, mountain slopes, dirt roads, grass and hard-packed or non-packed snow. The vehicle has at least three (3) but preferably four (4) wheels, or skis or a combination of wheels and skis which may or may not be on independent axles one from the other and which may or may not be each independently shock suspended. There is also a steering mechanism for steering the vehicle and a driver compartment portion for containing a driver of the vehicle in a prone face-down and face-forward position. The vehicle is steerable by the driver from the prone face-down and face forward position. The mechanism for suspension of the wheels and/or skis is configured to provide precise control in turns especially the carving of turns, by the skis, while descending on snow covered terrain. The attitude of the skis relative to the snow surface changes upon initiation of a turn and while in the turn to increase the edging of the skis thereby enhancing the turning characteristics of the vehicle. The vehicle may further have a braking system for slowing or stopping the vehicle and a harness apparatus for harnessing the driver onto and into the vehicle.

What is needed is a safe, two-wheeled "riding-board," having an outboard set of repositionable stabilizer wheels to limit a leaning excursion, and having a controllable, individually foot operated, dual actuatable braking system. In this regard, the present invention fulfils this need.

It is therefore an object of the present invention to provide for a two-wheeled "riding-board," having a set of outboard stabilizer wheels to limit a leaning excursion.

It is another object of the present invention to provide for a two-wheeled "riding-board," having a set of outboard stabilizer wheels to control the downward direction by the rider shifting his weight over the appropriate outboard wheel to attain the desired direction.

It is another object of the present invention to provide for a two-wheeled "riding-board," having a set of outboard stabilizer wheels that are obliquely angled forward, where the rider use a side wheel to kick or immediately pivot the board for turning to that side.

It is still another object of the present invention to provide for a two-wheeled "riding-board," having a set of outboard stabilizer wheels that are parallel to the length of the board (the axel is orthogonal to the board) for downhill riding on a severe downgrade hill or when the rider is confronted by a hill that includes various undulations or irregularities.

It is still yet another object of the present invention to provide for a two-wheeled "riding-board," having a set of outboard stabilizer wheels that are angled toward the rear of the board to provide more speed for downhill racing, such as in instances where the rider does not anticipate doing much turning.

It is yet still another object of the present invention to provide a controllable, individually foot operated, dual actuatable, braking system.

It is a final object of the present invention to provide a dual braking system, where the first is a manually operated triggered cable and the second automatically actuated using a tethered pull line.

A better understanding of these and other objects and advantages of the present invention will be best understood from the following description of the specific embodiments when read and understood in connection with the accompanying drawings.

SUMMARY OF THE INVENTION

The present invention relates to a novel two-wheeled riding-board that when in use provides a safe operating sport-ride to the user. To improve the safety of this novel riding-board, two large diameter wheels, one fore and the other, aft, are provided. Each wheel has a resilient elastomerically formulated, cushioned tire, mounted on each rim. The wheel brackets for securing the major wheels extend above the plane or surface of the board and the wheel axels are mounted at the extended bracket ends, providing the board with a low profile. The large diameter wheels give stability while the rider's feet are close to the ground on the low profile board, which affords a lower center of gravity for the rider with better board control even at top speeds. A dual set of smaller stabilizer wheels are mounted outward at the rear of the deck to prevent tipping over by limiting the travel when a leaning excursion is encountered, thereby providing safe operation.

The outboard repositionable stabilizer wheels also serve to function as maneuvering devices, where the rider, by shifting his body weight over one of the stabilizing wheels, can decisively change the direction of his descent, either to the left or to the right. The stabilizer wheels enable quick turns or cuts, for sharply changing direction as the rider descends a hill or track.

A foot operated dual actuatable braking system is provided where the brakes on each wheel are individually operated—the front wheel may be operated independently by simply rotating ones right foot in a clockwise direction to apply the braking action to the front wheel, as needed. Conversely, the rear wheel may also be operated independently by simply rotating ones left foot in a counterclockwise direction to apply braking action to the rear wheel, again, as required.

Riding a board takes skill, stamina, and agility; riders should be in excellent physical condition. An experienced rider can descend rapidly in all terrains without having the riding-board wobble from the deleterious effects of the wind. The rider has full control over the course traveled, including the change of direction, or the speed of descent.

In competition, a rider can ride downward using one of several basic moves. In the bottom turn, a rider can turn the riding-board sharply by shifting his weight towards one of the outboard wheels, using momentum and speed gathered from the descent to redirect the riding-board up the face of the terrain.

Maneuvers in the air, known as aerials, have gained popularity with a younger generation of surfers, inspired by the moves of skateboarding and snowboarding, while competing on a smooth surface. In an aerial called a 360, for example, a surfer completes a 360-degree spin while airborne.

BRIEF DESCRIPTION OF THE DRAWINGS

The figures shown in the accompanying drawings are described briefly as follows.

Figure 1:
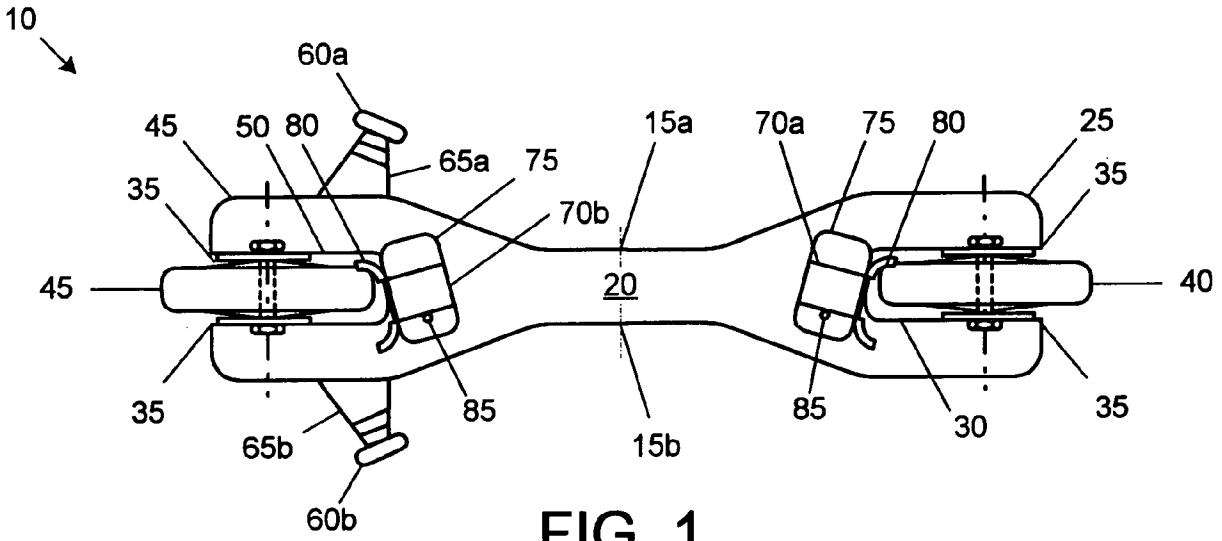
FIG. 1 is a top elevational view of the preferred embodiment of the two-wheeled riding-board.
Figure 2:
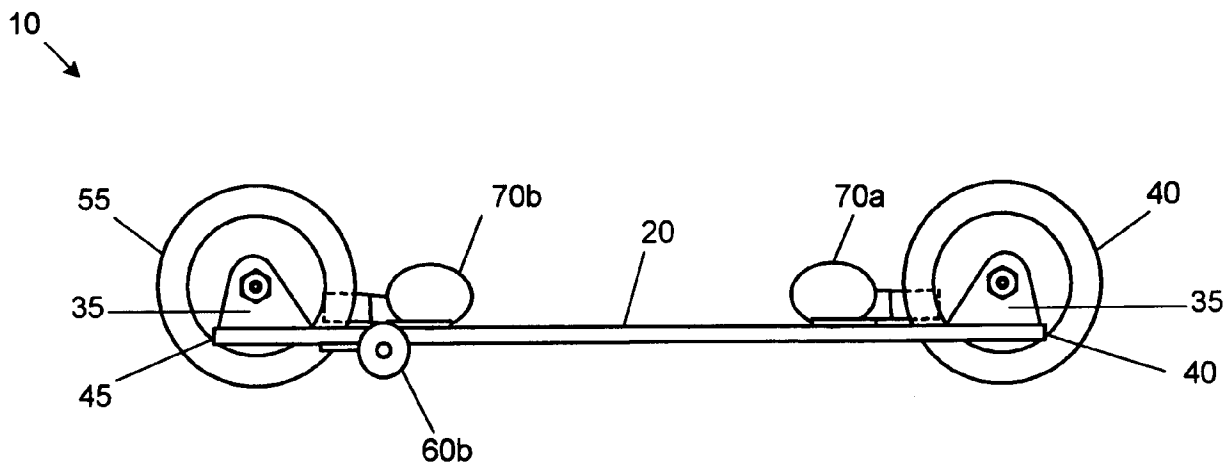
FIG. 2 is a top view of the preferred embodiment of the present invention, showing the outboard stabilizer wheels, positioned obliquely forward and canted outwardly.

A better understanding and appreciation of the present invention will be obtained upon reading the following detailed description of the present invention.

DETAILED DESCRIPTION OF THE INVENTION

There is shown in FIGS. 1 through 4, the all-terrain riding-board 10 of the present invention. This novel style of board can provide for an all-terrain sports activity, such as, on grass, dirt, snow or asphalt.

The deck 20 is manufactured using a deck material made of seven-ply laminated plywood. This type of fabrication tends to be lighter and stronger than those made of other materials. For the preservation of the plywood and appearance of the deck, a coating of polyurethane is applied over the entire surface.

The longitudinal sides are sidecut symmetrically resulting in the concave portions 15*a* and 15*b*, thereby reducing the weight and size of the deck 20.

The front or head 25 of the deck 20 has longitudinal slot 30 to which are rigidly mounted two wheel support brackets 35, located oppositely on each side of the front wheel cutout 30. A front wheel 40, comprised of preferably a spoked wheel and rim, has a 12-inch diameter elastomeric pneumatic tire mounted on it, and is axially secured between the two brackets 35.

In a similar manner, the rear or tail 45 of the deck 20 also has longitudinal slot 50, to which are rigidly mounted two wheel support brackets 35, located oppositely on each side of the tail wheel cutout 50. The rear wheel 55 is comprised of preferably a spoked wheel and rim that has a 12-inch diameter elastomeric pneumatic tire mounted on it, and is axially secured between the two brackets 35.

Toward the rear of the two-wheeled riding-board are protruding two stabilizing wheels 60*a* and 60*b*, where each is mounted on its respective stabilizing bracket 65*a* and 65*b*. The stabilizing brackets 65*a* and 65*b* are mounted and positioned in an obliquely forward facing manner, with the stabilizing wheels 60*a* and 60*b*, canted or tilted outwardly.

The outboard repositionable stabilizer wheels serve to function in keeping the board and rider from tipping over, and also serve to function as maneuvering devices, where the rider, by shifting his body weight over one of the stabilizing wheels, can decisively change the direction of his descent, either to the left or to the right. Having the set of outboard stabilizer wheels angled obliquely forward from the board longitudinal axis, the rider can use one of the side wheels to kick or immediately pivot the board for turning to that side.

Figure 3:
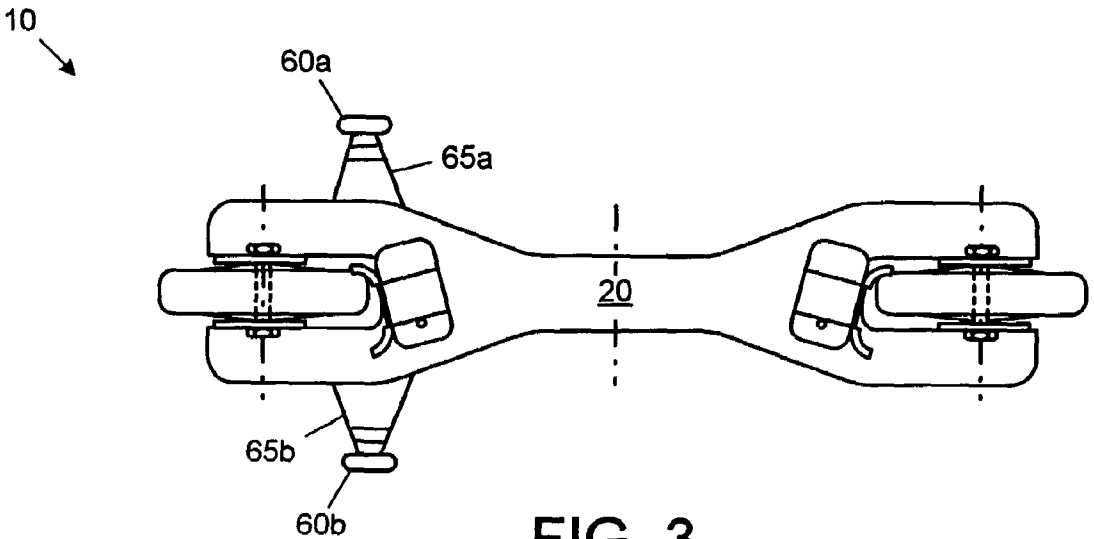
FIG. 3 is a top view of the preferred embodiment of the present invention, showing the outboard stabilizer wheels, positioned parallel to the length of the board and canted outwardly.

By having a set of outboard stabilizer wheels mounted in parallel to the length of the board, (where the axel is orthogonal to the board), as is shown in FIG. 3, the riding-board of the present invention performs more ideally and suitably for downhill riding on a severe downgrade hill or when the rider is confronted by a hill that includes various undulations or irregularities.

Figure 4:
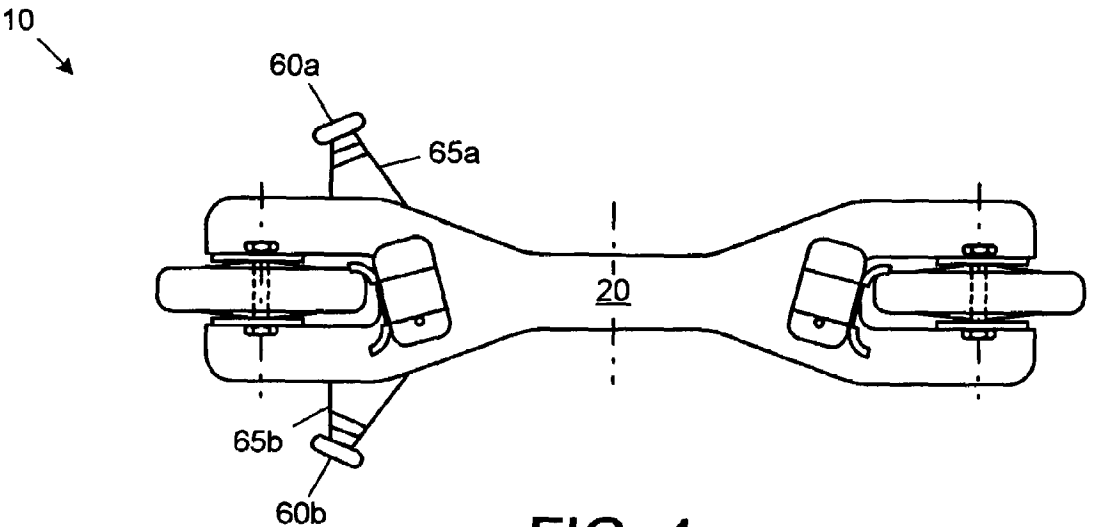
FIG. 4 is a top view of the preferred embodiment of the two-wheeled riding-board, showing the outboard stabilizer wheels, positioned obliquely to the rear and canted outwardly.

With the set of outboard stabilizer wheels angled obliquely to the rear, as is shown in FIG. 4, the riding-board of the present invention performs with greater speed for downhill racing, such as in such cases where the rider does not anticipate doing much turning.

To ride the two-wheeled riding-board, enthusiasts place both feet on the board about shoulder's width apart, so that one foot is in front of the other and the rider is standing sideways. The rider can then choose which foot to place in the front binding 70*a* and which foot to place in the rear binding 70*b*.

The best fitting binding is one where the foot fits snugly into a step-in sleeve 70 that is mounted to a swiveled breaking platen 75. In an alternative embodiment, Velchro straps with having easy release footstraps can also be used.

Each platen 75 is equipped with a curved break shoe 80 that when operated by one's foot, applies breaking pressure to the side of the wall of the tire. The platen 75 is secured by pivot point 85 that allows the rider to rotate his foot clockwise to apply the brake to the front wheel and that allows the rider to rotate his foot counterclockwise to release the brake from the front wheel.

The foot independently operated braking system permits the brakes on each wheel to be individually operated—the front wheel may be operated independently by simply rotating ones right foot in a clockwise direction to apply the braking action to the front wheel. Conversely, the rear wheel may also be operated independently by simply rotating ones left foot in a counterclockwise direction to apply braking action to the rear wheel.

In use, the rider will apply only one brake at a time, either the front or rear brake. The braking system is best suited on either the asphalt terrain or the dirt path terrain.

Another way to control speed is through having variations in tire pressure. When the tire pressure is low, the rider will experience a slowing down in performance. However, over-inflating the tires will make riding the board unsafe and may even destroy the tires.

Figure 5:
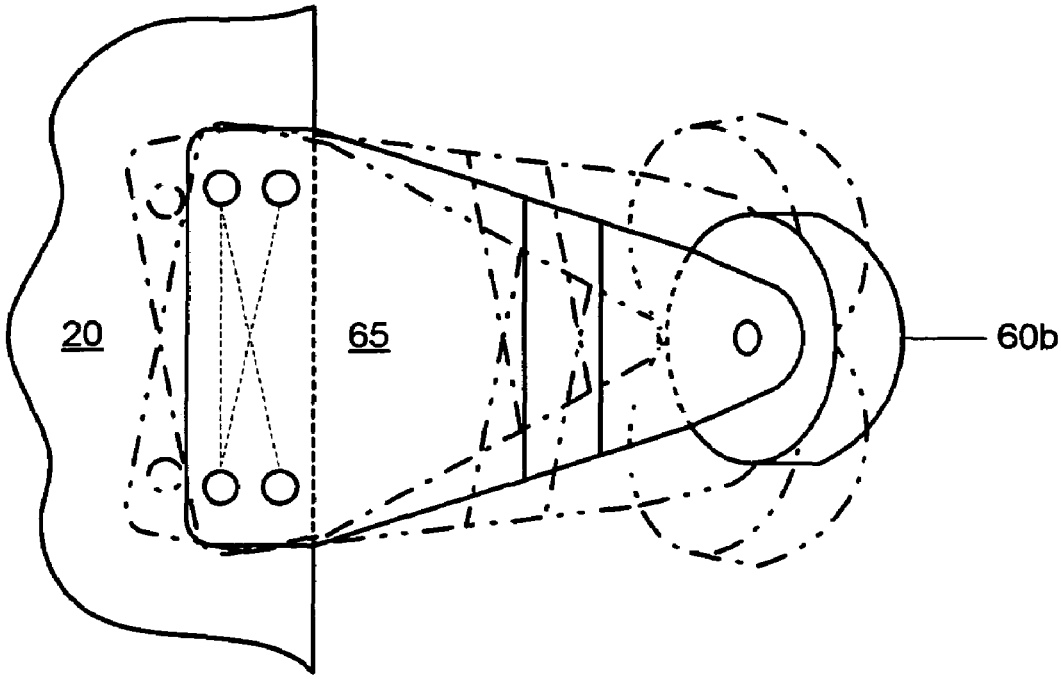
FIG. 5 is a bottom partial view of the preferred embodiment of the two-wheeled riding-board, showing mounting arrangement for the three positions of the outboard stabilizer wheel.
Figure 6:
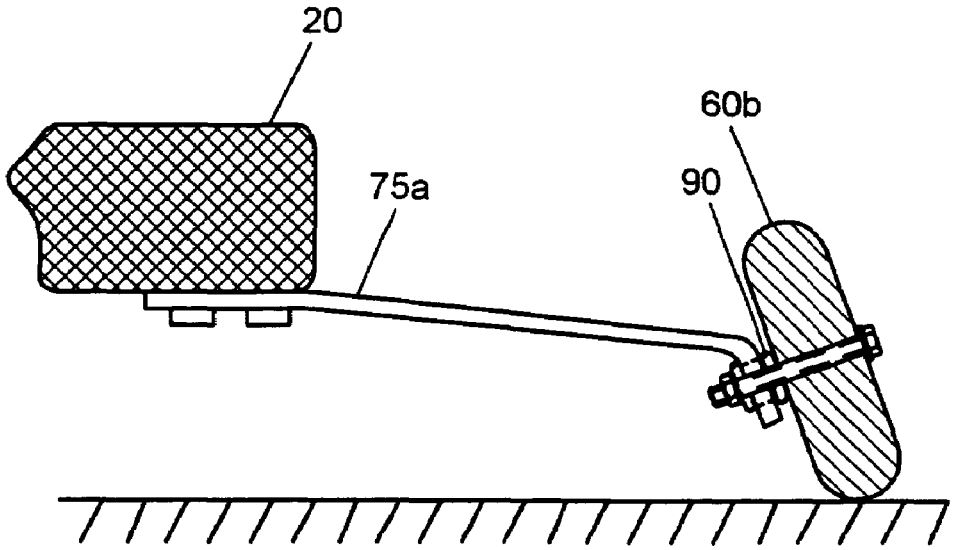
FIG. 6 is a side sectional view of the preferred embodiment of the two-wheeled riding-board, detailing the mounting arrangement for the canted outboard stabilizer wheel, and showing the shock-absorbing bushing.

With reference now to FIG. 5, the stabilizing wheel bracket assembly is shown in the three mounting arrangements; facing forward, facing rear, or parallel to the length of the deck. Four mounting holes in the bracket (each hole enlarged to provide the necessary clearance) are aligned with two holes in the underside of the deck. The stabilizing wheel bracket 65 is subsequently mounted and held securely in place using only two wood screws by selecting one from the two front facing holes and one from the two rear facing holes.

Turning now to FIG. 5, there is shown in section, one of the stabilizing wheel brackets 65, secured to underside of deck 20, and having a stabilizer wheel 60 mounted at the end of the bracket. The wheel mounting hole at the end of the bracket is enlarged to permit the insertion of rubber bushing 90. A cap screw then attaches the canted stabilizer wheel 60 to the bracket 65 by passing through the bushing 90. Because of the enlarged clearance hole, the wheel is permitted to perturbate, while still possessing a cushioning quality to provide for improved riding comfort.

Figure 7:
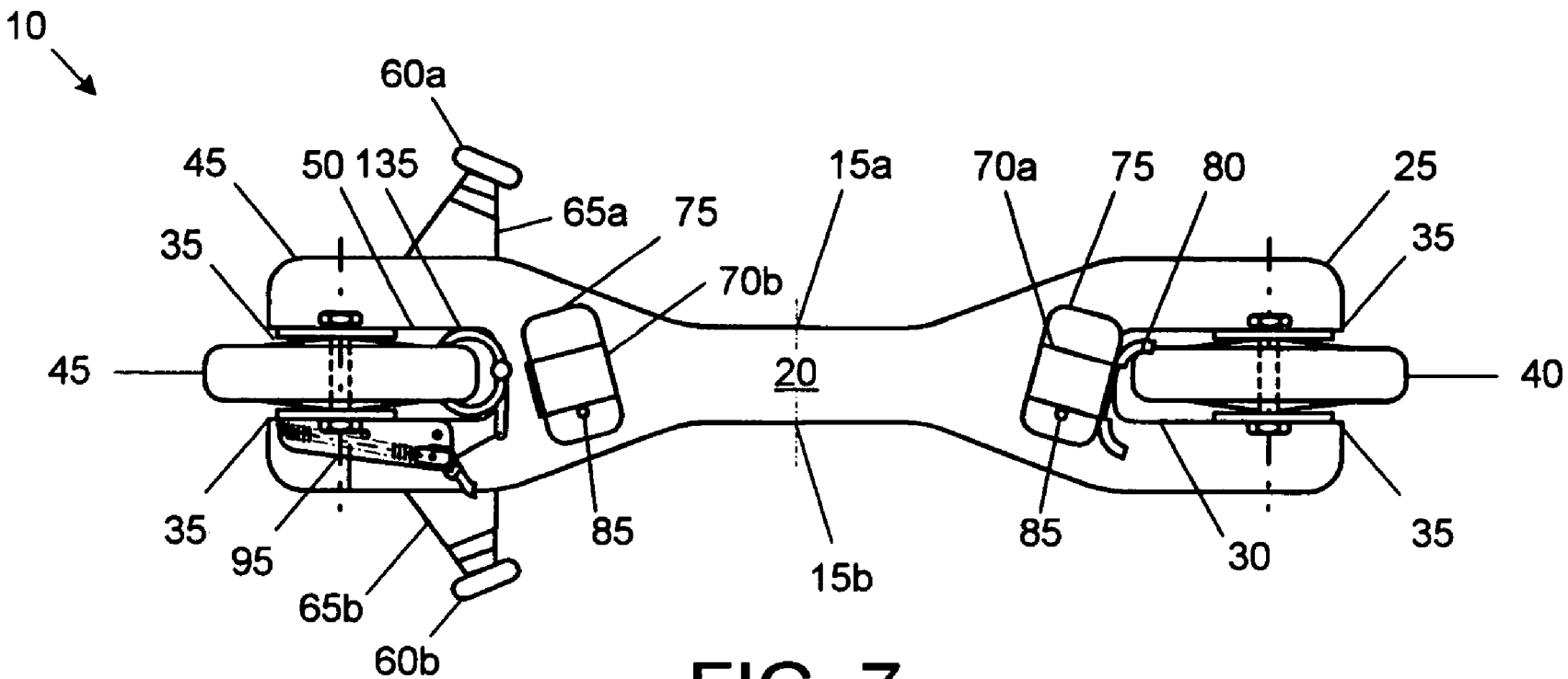
FIG. 7 is a top elevational view of an alternative embodiment of the two-wheeled riding-board, adapted to having a dual hill-and-hand braking system mounted to the riding board.

In another aspect of the present invention, there is shown in FIG. 7, the riding board 10 having the automatic hill-braking assembly 95 for the riding board of the present invention, where the hand-operated caliper brake 100 engages the rim of the rear wheel 45.

Figure 8:
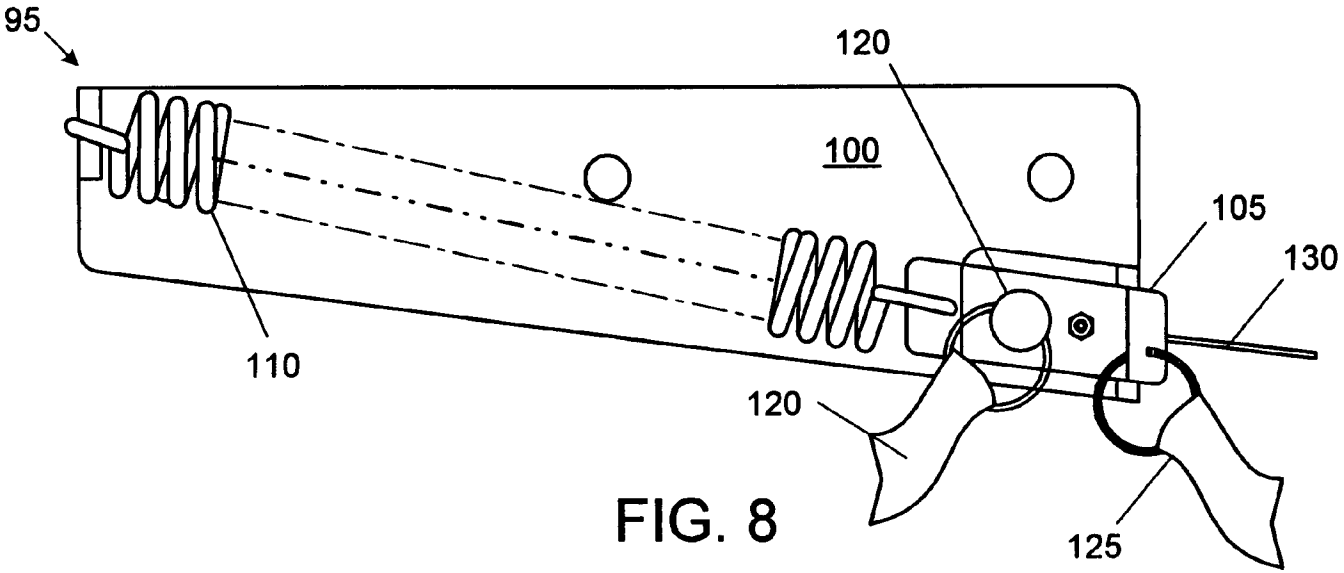
FIG. 8 is a top view of the novel dual braking system having both a manually hand-operated and an automatically actuated tethered, hill-braking system of the two-wheeled riding-board.
Figure 9:
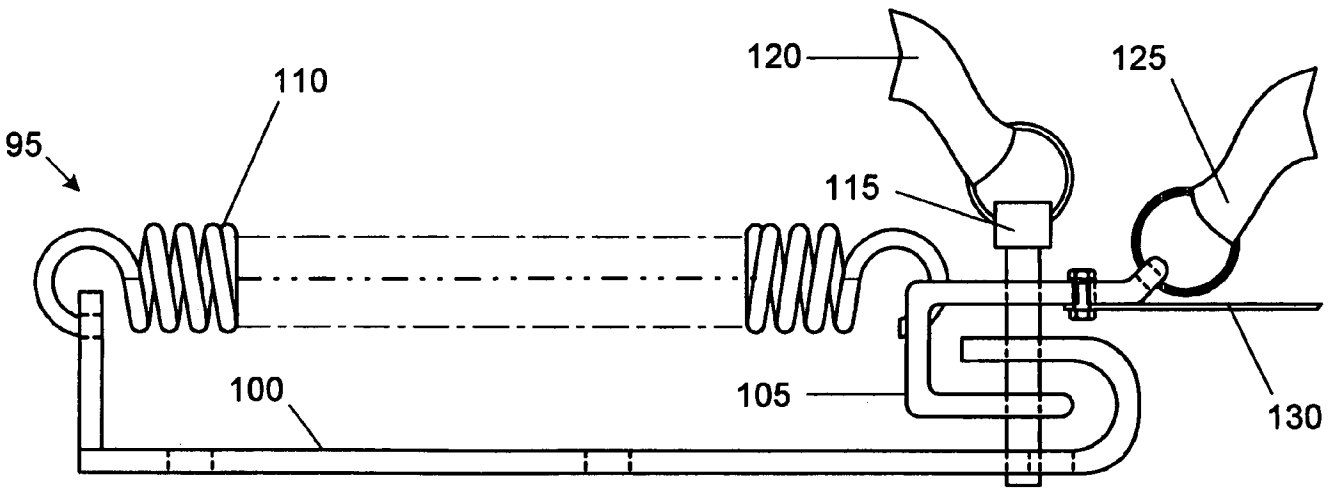
FIG. 9 is a side view of the novel dual braking system having both a manually hand-operated and an automatically actuated tethered braking system of the two-wheeled riding-board.

Turning now to FIGS. 8 and 9, there is shown a detailed view of the automatic hill-brake assembly 95.

The automatic hill-brake assembly 95 is comprised of the hill-brake braket 100, a tether release bracket 105, an extension spring 110, a tether release pin 115, the tether release strap and ring 120, the brake reset strap and ring 125, and the brake connecting link 130.

In arming the automatic hill-brake assembly 95, the brake reset strap and ring 125 is pulled in a direction to extend spring 110, commensurately while aligning the two pin receiving holes in the tether release bracket 105 with the two pin receiving holes in the hill-brake bracket 100. To insert the pin 115, the pin is first inserted through the upper hole in the tether release bracket 105, then through the top hole of the hill-brake bracket 100, then passing through the lower hole of the tether release bracket 105, and finally passing through the bottom hole of the hill-brake bracket 100. Once the pin 115 is inserted through the sequence of four holes, the tension exerted upon extension spring 125 is relaxed, thereby captivating the release pin 115. Secured to the underside of tether release bracket 100 by a nut and bolt is the brake connecting link 130, which is ultimately is attached to the actuating arm of the caliper brake assembly as shown in FIG. 10.

Figure 10:
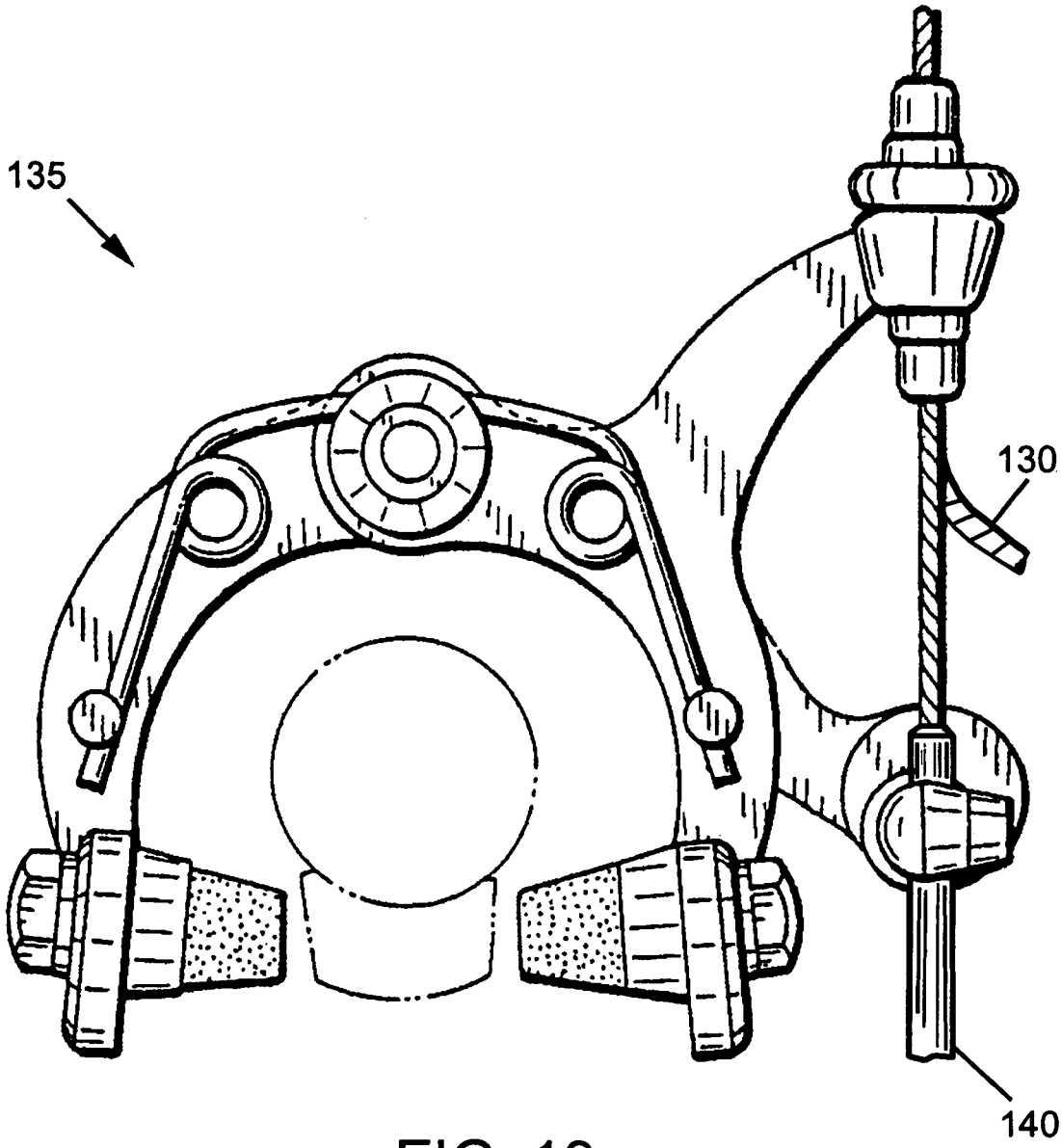
FIG. 10 is a top view of a PRIOR ART caliper brake as incorporated in the present invention.
Figure 11:
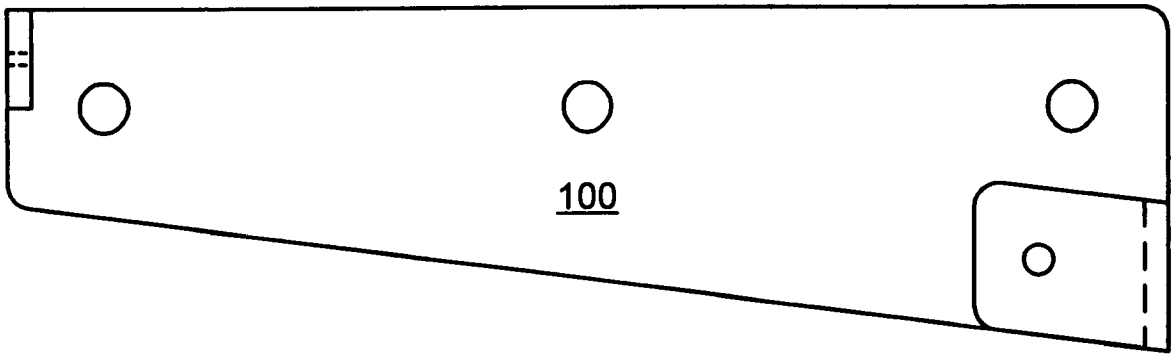
FIG. 11 is a top view of the automatic hill-braking system bracket.
Figure 12:
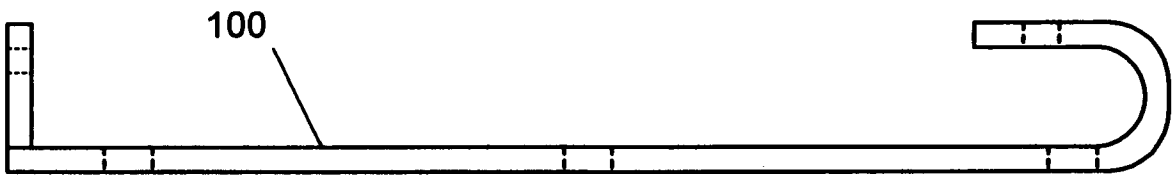
FIG. 12 is a side view of the automatic hill-braking system bracket.

With reference now to FIG. 10, there is shown a typical spring loaded caliper brake 135, where the hill-brake connecting link 130 and the manually-operated hand-brake cable 140 are securely attached to the actuating arm of the caliper brake 135. The two single turn coil springs of the caliper brake maintain the brake in an open position, thereby allowing the brake pads to not make contact with the wheel rim.

In typical use, the hill-brake can be secured to the rider by wrapping the tether strap 120 about the riders wrist or ankle, so that when the rider dismounts, the pin 115 disengages, thereby triggering a rapid braking action, and causing the riding board to stop in its tracks.

Also, the hand-brake has a hand held braking grip attached to the end of cable 140, where a controlled braking action can be invoked by squeezing the grip proportionately as needed.

Whereas the present invention is described in detail for its particular embodiments, there may be other variations and modifications that will become apparent to those who are skilled in the art upon reading this specification, and that these modifications or variations can be made without detracting from the true spirit of this invention.

I claim:

1. A riding board, comprising a deck with forward and aft sections, each section having a longitudinal slot with two wheel support brackets mounted oppositely in each side of the slots;

an axel of a large diameter wheel secured in the support brackets of each longitudinal slot;

the deck including longitudinal sidecuts that form narrowed portions near a center portion of the deck with a consequent increased flexibility of the board;

a repositionable stabilizer projecting radially outward from each side of the deck near the aft section, each stabilizer having a stabilizing bracket and a canted stabilizing wheel mounted on an end of its respective bracket;

each stabilizer bracket having an enlarged mounting hole that receives a resilient rubber bushing which surrounds a cap screw that attaches each canted stabilizing wheel to the bracket;

further comprising a dual braking system including a manually operated hand-brake and an automatic hill-brake assembly.

2. The riding board in accordance with claim 1, further comprising a means lowering a rider's center of gravity to achieve greater board control and stability.

3. The riding board in accordance with claim 2, wherein each of the wheel support brackets includes an upward extension from a top surface of the board with each axel secured near a terminus of the upward extension that provides a lowered, close to the ground, profile of the board, and a concomitant lowered center of gravity of a board rider, for enhanced stability and board control even at top speeds.

4. The riding-board as recited in claim 3, further comprising a stabilizing wheel bracket assembly having three mounting arrangements.

5. The riding-board as recited in claim 4, wherein each wheel bracket is in an angled position with an obliquely forward facing mode for abruptly turning the board in a left or right direction, an angled aft arrangement, and an arrangement wherein the wheel bracket is essentially orthogonal to a longitudinal axis of the board.

6. The riding-board as recited in claim 5, wherein each wheel bracket is essentially orthogonal the a longitudinal axis of the board and each stabilizer wheel is essentially parallel to said axis.

7. The riding-board as recited in claim 6, wherein each wheel bracket is angled obliquely toward the aft section wherein the stabilizer wheels provide less friction, for high speed performance in downhill racing.

8. The riding-board as recited in claim 7, further comprising an enlarged wheel mounting clearance hole at the end of each bracket that receives a shock-absorbing rubber bushing with a cap screw through the bushing for attachment of a canted stabilizer wheel to the bracket that perturbates a wobbling motion concurrent with its intermittent contact with a surface alongside the board.

9. The riding-board as recited in claim 8, the manually operated hand-brake assembly comprising a hand-operated caliper brake that engages a rim of the large diameter wheel near the aft section of the board, which includes a hill-brake connecting link and a hand-brake cable both secured to an actuating arm of the caliper brake.

10. The riding-board as recited in claim 9, the automatic hill-brake assembly comprising a hill-brake bracket with two pin receiver holes, the bracket fixed to the deck proximate to a large diameter wheel in a tail portion of the deck; a tether release bracket with a pair of receiver holes positionable for coinciding with the hill-brake bracket receiver holes, the tether release bracket including an attached hill-brake connecting link that also attaches to the caliper brake actuating arm; and a tether strap fixed to a pin that is captivated in the receiver holes by tension of a spring extended from an end of the hill-brake bracket to the tether release bracket and wrapped on a rider's wrist or ankle, wherein an intended or unintended dismount of the rider disengages the pin and triggers a rapid braking of the board.

11. The riding-board as recited in claim 10, further comprising a front rotatable platen positioned near a front wheel and a rear rotatable platen positioned near a rear wheel.

12. The riding-board as recited in claim 11, wherein each platen is mounted to the riding-board on a pivot and each platen includes a curved brakeshoe that upon rotation of the front or rear platen by rotation of a rider's front foot or rear foot, the brakeshoe frictionally contacts its respective nearby wheel to slow or stop the riding-board.

* * * * *